United States Patent [19]

Huntress et al.

[11] 4,028,491

[45] June 7, 1977

[54] TRANSDUCER SWITCHING SYSTEM

[75] Inventors: Charles B. Huntress, Orange; Henry Gabrielian, Newport Beach, both of Calif.

[73] Assignee: Electronic Engineering Company of California, Santa Ana, Calif.

[22] Filed: Apr. 2, 1976

[21] Appl. No.: 673,182

[52] U.S. Cl. ..... 179/1 SW; 179/1 E; 200/276

[51] Int. Cl.[2] ..... H04R 1/00

[58] Field of Search ..... 179/1 SW, 1 PC, 1 VE, 179/1 ST, 183 A; 181/137, 131, 151; 200/276

[56] References Cited

UNITED STATES PATENTS

| | | | |
|---|---|---|---|
| 2,765,365 | 10/1956 | Grosh et al. | 179/1 SW |
| 3,353,625 | 11/1967 | Scanlon | 181/151 |
| 3,463,886 | 8/1969 | Scanlon | 179/1 VE |
| 3,610,830 | 10/1971 | Daleiden | 179/1 SW |
| 3,842,230 | 10/1974 | Kashio et al. | 200/276 |

*Primary Examiner*—William C. Cooper
*Assistant Examiner*—E. S. Kemeny
*Attorney, Agent, or Firm*—Harry R. Lubcke

[57] ABSTRACT

A transducer switching system for, in effect, removing electrical energy from a transducer without breaking the electrical circuit. A resistor is in series with the transducer. An electro-mechanical switch shunts the resistor. The switch is within the enclosure containing the transducer. When the acoustic connector of a use-element, such as a stethoscope type headset for a listener, is inserted into the enclosure the switch is changed from its normally open state to a closed state, thereby shorting out the resistor and allowing an effective level of electrical power to operate the transducer. Two systems may be simultaneously actuated for stereophonic sound.

10 Claims, 4 Drawing Figures

TRANSDUCER SWITCHING SYSTEM

BACKGROUND OF THE INVENTION

This invention pertains to electro-mechanical switching systems.

Stereophonic sound, the sound accompanying motion pictures, monaural sound, and possibly other acoustic information is now frequently made available to persons on an individual basis. This mode is widespread on transport aircraft.

It has been found as a practical matter that the electrical energizing system for such purposes is typically in operation on almost a 24 hour per day basis. If program material is not supplied, then a 1 to 6,000 hertz square-wave test signal is frequently maintained; thereby to enable a ready check to determine whether or not the few hundred seats in the vehicle have an operative electro-acoustic system.

Because of the steep wavefronts of the square waveform, this signal is known to cause failure of the electrical to sound transducers long before normal use would cause failure. Also, normal use tends toward failure, and any means that removes the transducers from operation other than when useful operation is required to provide sound to a passenger, has been calculated to extend the life of a transducer about 800%.

Locating a pair of small transducers in the arm rest of a seat in an airplane is known. Also, the use of an acoustic plug therein that prevents sound from being emitted except when a hollow acoustic connector, usually a pair for stereo sound, is inserted into the enclosure containing the transducers is known. Further, an electrical bridging contact in the acoustic connector has been proposed for distrubution to passengers who pay to hear certain sound programs, such as that pertaining to a motion picture.

Another arrangement has been proposed in which two transducers are contained within the known housing having an insertable acoustic-use element and a switch is included within the housing. The configuation is adapted to allow selective operation of the transducers with respect to two or more sources of signal. An open circuit occurs when a transducer is not energized. The structure of the switch shown is atypical to a preferred arrangement for these elements.

Another arrangement is known that has the nature of an acoustic manifold. One transducer has a chamber into which a pluraity of stethoscope-like listener devices may be selectively plugged. The acoustic orifices are sealed when a listener device is not plugged in.

SUMMARY OF THE INVENTION

An enclosure contains an electro-acoustic transducer and has an acoustic plug. This is mechanically actuated to pass sound when an acoustic connector leading to listener means is inserted into the enclosure. Within the small space available within the enclosure a normally-open electric switch is provided by including a spring that heretofore has mechanically coacted only with the acoustic plug.

A resistor is connected in series with the transducer and reduces the power flowing through the transducer to a negligible value while nonetheless maintaining circuit continuity until an acoustic connector is inserted.

The spring rests upon one electrical contact and touches a second contact when compressed by insertion of the acustic connector. The switch is thus closed, shorting out the resistor, and the transducer receives normal power.

An electrical function is thus accomplished by an element required for mechanical functioning.

For stereophonic installations the structure is merely doubled.

DESCRIPTION OF THE PREFERRED EMBODIMENTS

Figure 2:
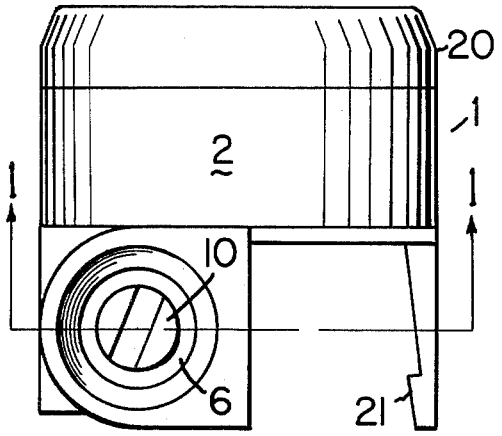
FIG. 2 is a top plan view of the same.
Figure 3:
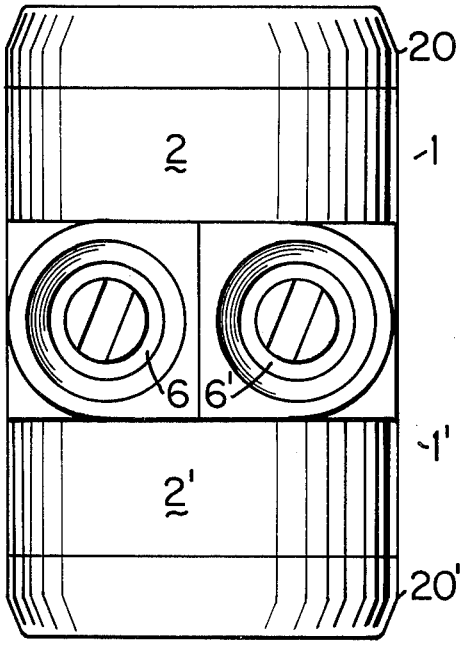
FIG. 3 is a top plan view of the same, duplicated for stereophonic sound.
Figure 1:
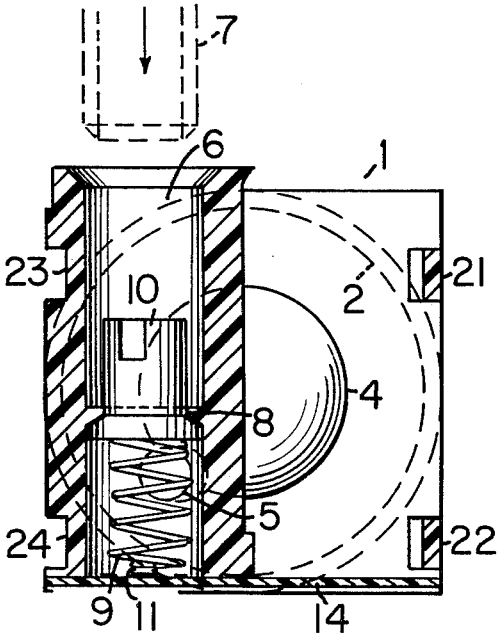
FIG. 1 is a sectional elevation of a single (monaural) embodiment of the transducer switching system, taken along line 1 — 1 in FIG. 2.

In FIGS. 1 and 2 numeral 1 generally indicates a transducer-switch body suited to handle monaural sound. In FIGS. 3 and 5 this body is duplicated to handle binaural or stereophonic sound.

Figure 4:
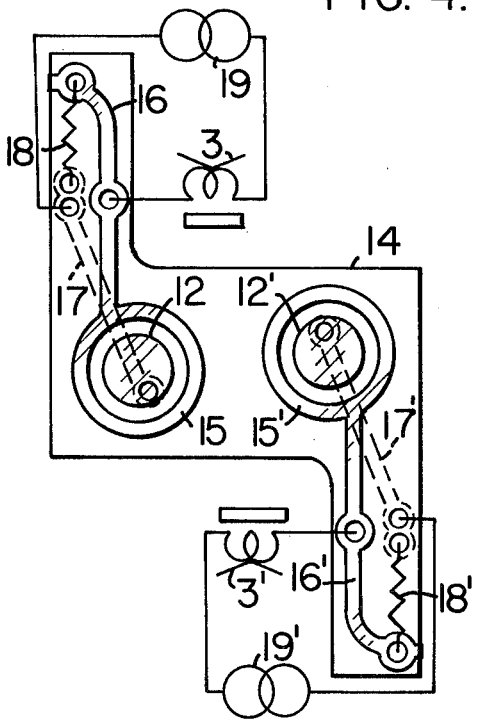
FIG. 4 is a top plan view of a printed circuit board, showing schematically the electrical circuits for stereophonic sound.

Within the cylindrical portion is contained a small electrodynamic electricity to sound transducer. This may be of a known permanent magnet and voice coil type. While the whole transducer-switch body may be fabricated in any size the device illustrated is approximately three times larger than the size of one preferred model. The transducer is shown schematically at 3 in FIG. 4.

The sound from the transducer is emitted upward through the paper in the drawing of FIG. 1 and pases into chamber 4, which is shown as a bulge in FIG. 1. The chamber is on the other side of this wall within body 1.

Therefrom the sound passes through orifice 5 into cylindrical female acoustic-use cavity generally indicated as 6. A male acoustic-use connector 7, fragmentarily shown, has an orifice connecting to flexible tubing and to the headset for a listener in the known manner. This arrangement is duplicated for stereophonic listening, as indicated at 6 and 6′ in FIG. 3.

Acoustic plug 10 is contained within cavity 6 and is normally urged against shoulder 8 by spring 9 to accomplish an acoustic seal between chamber 4 and externally with respect to cavity 6. This is so that pasenger-potential-listeners who have not paid for a headset will not be able to hear the program in a typical installation, such as in an airplane.

When male acoustic-use connector 7 is fully inserted into cavity 6 it displaces acoustic plug 10 downward against spring 9.

This performs the mechanical acoustic function of opening the passage between the transducer and the headset. Sound from orifice 5 passes beyond the now opened shoulder 8 constriction, up through cavity 6, through hollow connector 7 and to the listener's headset (not shown).

An electrical function is also performed in that switch contacts are closed by a downward deformation of spring 9.

This spring has a lower central portion 11 that constantly rests upon a central fixed contact 12; for instance, a conductive part of a printed circuit board 14. See FIG. 4. This occurs because the uncompressed length of the spring is fabricated to be greater than the length of the lower part of cavity 6 even when plug 10 is in the closed (upward) position.

When downward deformation occurs the first large diameter convolution of spring 9 contacts an annular contact 15, which surrounds contact 12. This closes the circuit of the switch formed of contacts 12 and 15.

The spring may be fabricated of beryllium copper wire that is approximately 0.3 mm diameter, and it may have four large, one intermediate, and two small convolutions. The large diameter convolutions may be 6 mm in diameter. The spring may be heat treated and age-hardened for dependability and long life. Typically, it is operated at a safe fraction of its yield strength, such as one-fourth.

The beryllium copper material makes a satisfactory electrical contact and has a long useful life. Other materials of like characteristics may, of course, be used, including beryllium copper based materials having a different composition, and gold plating.

With respect to the printed circuit, conductor 16 lies upon the upper surface of the board and connects to annular contact 15. Conductor 17 lies upon the lower surface and connects to central contact 12. The other ends of these conductors connect to a resistive element, such as resistor 18.

External connection is made from conductor 16 to one terminal of the voice coil or appropriate transformer (not shown) of transducer 3. External connection is also made from conductor 17 to one terminal of a source of signal 19. This is typically one circuit of a stereophonic magnetic tape reproducer, or the sound circuit of a motion picture projector, and by switching means that have not been shown may selectively be either. The external circuit is completed by a connection between source 19 and transducer 3.

It will be recognized that the electrical elements are in an essentially series circuit, with switch 9, 11, 12 & 15 being shunted across the resistor, additionally.

The resistive value chosen for the resistor is high with respect to the impedance of other elements in the circuit, notably the impedance of transducer 3. In a preferred embodiment the resistance of the resisitor is approximately 33 times the impedance of the transducer. A resistive value of 10,000 ohms is suitable. The wattage rating of the resistor may be approximately 1/4 watt.

It will be seen that when connector 7 is absent from transducer structure 1 the series circuit resistance will be high. In a typical embodiment only 0.16 milliwatts of power is available at the transducer. This results in the transducer being essentially unenergized; thus, no sound is emitted. Under the same circumstances, when connector 7 is fully pushed down in cavity 6, 320 milliwatts of signal energy is available to the transducer. This is normal energization. The exact signal level desired may be controlled by a known volume control, which has not been shown, but which may be placed in series in the circuit.

How this "off-when-not-used" mode of operation greatly lengthens the life of the transducer 3 was considered above in the background of the invention. The increase in life is typically 800%. It has been found that the very low frequencies of the square-waveform test signal are the most damaging to the transducers.

Additionally, with this invention the transducer is essentially turned off electrically. This makes it impossible for a non-paying passenger to hear the music or sound programs that otherwise often leak acoustically past plug 10. With seats having arm rests that fold upward it is relatively convenient for such a passenger to hear the programs by merely raising the arm rest upward to their ear, since the transducer is invariably placed at the forward end of the arm. Prevention of this activity is an attractive economic feature to airline companies.

The cylindrical portion 2 of the transducer-switch body 1 is provided with an imperforate cap 20. This cap is a tight fit between a groove and lip on elements 1 and 2. The purpose is to protectively house the transducer and to isolate it from ambient sounds and conditions.

A pair of snap arms 21 and 22 are formed into body 1, as seen in FIGS. 1 and 2. These fit into companion grooves 23 and 24 when two bodies are fastened together, as shown in FIG. 3. The hook at the end of each arm slips into a cmpanion slot of the other body when the two are fully together. The arms can be pried outward when it may be desired to separate the bodies.

A pair of bodies allows stereophonic sound to be delivered out of a pair of connectors and so to be separately conveyed to the two ears of a listener. Herein, the second stereo channel is identified by primed (′) numerals that correspond to the first channel, which channel has been fully discussed.

Typically, the second channel is a mirror image of the first, both mechanically and electrically.

The printed circuit may be gold or nickel over copper on an epoxy fiberglass-filled board. The board slides into grooves as shown in FIG. 1 at the bottom edge, and thus is firmly retained in the structure.

A synthetic ploymeric amide (as Nylon), or a polycarbonate, may be used as the material for molding the transducer switch bodies 1.

The proportions shown may be varied to accomodate different sized transducers within cylindrical portion 2, or nature and spacing of the acoustic connectors 7.

We claim:

1. A transducer switching system comprising;

a. an electro-acoustic transducer (3) having an enclosure (1) with an acoustic plug, (10)

b. an electrical resistive element (18), c. an acoustic-use connector (7), d. resilient electrically conductive means (9) having a small central part away from said acoustic-use connector, and deformable upon the insertion of said acoustic-use connector into said enclosure, to thereby move said acoustic plug, and e. circuit means to conduct (16,17), connecting said transducer and said resistive element having electrical contact members (12, 15) adjacent to said resilient electrically conductive means, whereby deformation of said resilient electrically conductive means by the insertion of said acoustic-use connector electrically shorts said resistive element from the circuit.

2. The system of claim 1, in which said electrical contact members include;

a. a central contact (12) constantly in contact with said resilient electrically conductive means, and b. an annular contact (15) surrounding said central contact and contactable by said resilient electrically conductive means.

3. The system of claim 2, in which;

a. said central and said annular contacts are formed of a printed circuit (14, 12, 15).

4. The system of claim 2, in which;

a. said resilient electrically conductive means is a coiled spring having a small lower portion (11) in contact with said central contact (12), and having a large upper portion (9) deformable to contact said annular contact (15) .

5. The system of claim 1, in which;

a. said acoustic-use connector is a tubular acoustic connector (7) for conveying sound therethrough.

6. The system of claim 1, in which;

a. said circuit means to conduct is a printed circuit (14, 16, 17) disposed at the bottom of said enclosure (1).

7. The system of claim 1, in which;

a. each of the recited elements is provided in pairs (1, 1′), for handling stereophonic sound.

8. The system of claim 1, in which;

a. the resistance of said electrical resistive element (18) is of the order of thirty-three times the impedance of said electro-acoustic transducer (3).

9. The system of claim 1, in which;

a. said resilient electrically conductive means is fabricated of a beryllium copper based material.

10. The system of claim 1, in which;

a. said enclosure (1) is fabricated of a synthetic polymeric amide.

* * * * *